US006332341B2

(12) United States Patent
Matsuda

(10) Patent No.: US 6,332,341 B2
(45) Date of Patent: Dec. 25, 2001

(54) SLIDE FASTENER TAPE COMPOSED OF WARP YARN KNITTING STRUCTURE

(75) Inventor: Yoshio Matsuda, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/791,787

(22) Filed: Feb. 26, 2001

(30) Foreign Application Priority Data

Mar. 8, 2000 (JP) ..... 12-063757

(51) Int. Cl.[7] ..... D04B 21/00
(52) U.S. Cl. ..... 66/192; 24/393; 66/195
(58) Field of Search ..... 66/190, 192, 193, 66/195, 196; 24/413, 392, 393

(56) References Cited

U.S. PATENT DOCUMENTS 3,864,946 * 2/1975 Matsuda ..... 66/193
3,926,017 * 12/1975 Matsuda ..... 66/193
3,983,721 * 10/1976 Matsuda ..... 66/193
4,022,034 * 5/1977 Matsuda ..... 66/193
4,047,402 * 9/1977 Matsuda et al. ..... 66/193
4,444,026 * 4/1984 Matsuda ..... 66/202
4,450,694 * 5/1984 Matsuda et al. ..... 66/193
5,586,454 * 12/1996 Matsuda et al. ..... 66/193
6,180,545 * 1/2001 Okeya et al. ..... 66/193

* cited by examiner

*Primary Examiner*—Danny Worrell
(74) *Attorney, Agent, or Firm*—Finnegan, Henderson, Farabow, Garrett & Dunner, L.L.P.

(57) ABSTRACT

The invention intends to provide a slide fastener tape capable of securing flexibility and attaching strength without losing proper flexibility of knitted fabric and having a warp knitting structure allowing an element to be attached uniformly. In this slide fastener tape, its element attaching portion is knitted with warp yarn integrally with a tape main body along a side edge thereof formed by warp knitting structure of one needle row of double row needles. The slide fastener tape is composed of plural groups of double tricot knitting structures lapped alternately between double row needles so as to surround a peripheral face of a core material and a knitting structure which is part of the tape main body. Needle loops of the knitting structure, which is part of the tape main body, are overlapped with needle loops, which are part of the double tricot knitting structure. Consequently, swellings of front and rear surfaces across the tape face in the element attaching portion are substantially equal, thereby securing flexibility and attaching strength of an element and allowing the element to be attached uniformly.

5 Claims, 8 Drawing Sheets

SLIDE FASTENER TAPE COMPOSED OF WARP YARN KNITTING STRUCTURE

BACKGROUND OF THE INVENTION

1. Field of the Invention

The present invention relates to a slide fastener tape composed of warp yarn knitting structure having an element attaching portion on which a fastener element is attached, the element attaching portion being formed by knitting in a swollen state along a side edge portion of a knitted tape main body.

2. Description of the Related Art

In recent years, a slide fastener has been attached to various kinds of flexible clothes, so that a fastener tape itself has been demanded to have flexibility. Therefore, various kinds of knitted fastener tapes having much more flexibility than woven fabric have been developed. Particularly, in view of its flexibility and stability of the state, warp knitted fastener tape has been widely used.

For example, according to Japanese Utility Model Publication No. 56-16088, as a first embodiment thereof, a tape main body is formed of double structures by double row needles and an element attaching portion to be connected to the main body is formed of a double tricot knitting structure by the double row needle in a swollen state, so as to surround a core material. Further, as a second embodiment of the same publication, an edge portion of the tape main body on a side of the element attaching portion is formed of the double structures by double row needles and the element attaching portion to be connected to the main body is formed of the double tricot knitting structure by the double row needle so as to surround the core material.

According to Japanese Patent Application Laid-Open No. 8-56713, for example, the tape main body is formed of single layer structure by only a needle of the front surface or rear surface. The element attaching portion is composed of double chain knitting structure knitted with two knitting yarns disposed on the core material and both sides thereof, a weft yarn inserting structure by weft yarn inserted with being swung symmetrically to the right and left between knitting patterns of the chain knitting structure and another weft yarn inserting structure comprised of the tricot knitting structure, chain knitting structure and normal weft yarn knitting structure, composing part of the tape main body. The double chain knitting structures and the weft insertion yarn of the element attaching portion are respectively knitted into the front surface and rear surface of the tape main body alternately so as to form the element attaching portion in a substantially completely rectangular section.

In the fastener tape for slide fastener composed of such warp knitting structure, irrespective of whether the tape main body is composed of the single structure by a single row needle or the double structures by the double row needles, the aforementioned element attaching portion is formed such that it is swollen with a larger thickness than the tape main body so as to surround the core material extended in the longitudinal direction with the double warp knitting structures.

Therefore, if it is intended to form the swollen element attaching portion integrally with the tape main body by the warp knitting structure, necessarily it has to be knitted by means of a double row needle knitting machine. To form the element attaching portion having the aforementioned structure, the core material is provided in the middle of the double row needles and the element attaching portion is formed by double row needles.

If it is intended to form the tape main body with double structures by double row needles like the element attaching portion, the core material is disposed on the line passing the center of an end face in a side edge portion of the tape main body in the longitudinal direction because the tape can be formed symmetrically to the front and rear surfaces. Therefore, it is possible to form the swelling state on the front and rear surfaces of the element attaching portion symmetrically to the front and rear surfaces.

If the tape main body is intended to be formed of a single structure using only one side of double row needles, however, the core material is deviated toward the-other side of the double row needles from the center of the end face in the side edge portion of the tape main body, even if the side edge portion in the tape main body is formed of double structures as disclosed in the second embodiment of the aforementioned Japanese Utility Model Publication No. 56-16088 as well as in the fastener tape disclosed in the aforementioned Japanese Patent Application Laid-Open No. 8-56713. Consequently, the swelling state of the element attaching portion is also deviated toward the other side, so that upon implanting the element, the element cannot be implanted equally on the same plane, thereby causing some disadvantages such as obstructing a smooth sliding of the slider.

According to the knitting structure disclosed in the publication, the warp knitting structure in the tape main body is composed of the chain knitting structure and weft yarn inserting structure. The weft yarn inserting structure of those structures is only interlaced with needle loops in part of the double tricot knitting structure, which is the warp knitting structure in the element attaching portion, and connected to the element attaching portion. Therefore, knitting pattern density at the connecting portion tends to be coarse, so that it is difficult to secure a desired attaching strength of the element.

If the tape main body is composed of the double structures as described above, the main body is formed thick so as to increase rigidity, so that flexibility expected for knitted fabric may be lost. Therefore, an initial purpose thereof cannot be achieved.

SUMMARY OF THE INVENTION

Accordingly, an object of the invention is to provide a slide fastener tape capable of securing flexibility and attaching strength without losing a proper flexibility of knitted fabric and having a warp knitting structure allowing the element to be attached uniformly.

To secure a flexibility in the slide fastener tape having a warp knitting structure of this type, it is preferable to knit the tape main body in a single layer structure. On the other hand, to secure a sufficient attaching strength of the element, it is preferable to form the element attaching portion in such a swelling state that the core material is incorporated internally with double layer structure like the conventional art.

As a result of accumulated considerations and repeated trial productions, it has been found that if the tape main body is formed by one needle row and the element attaching portion is formed of double layer structure by double needles while inserting the core material between the double row needles, the core material is always deviated toward one side of the tape surface of the tape main body.

Then, a further consideration based on this finding was carried out and finally, the following invention was reached.

According to a main aspect of the Invention, there is provided a slide fastener tape composed of warp knitting structure having an element attaching portion formed integrally with a tape main body along a side edge thereof, being characterized in that the tape main body is composed of warp knitting structure formed by one row needle of double row needles, and the element attaching portion has a core material and is composed of plural groups of double tricot knitting structures lapped alternately between double row needles so as to surround a peripheral portion of a core material and a knitting structure, which is part of the tape main body, and needle loops of the knitting structure, which are part of the tape main body, are overlapped with needle loops, which are part of the double tricot knitting structure.

According to the invention, because the tape main body is composed of a single layer structure using one needle row of the double row needles, this fastener tape can secure flexibility particular to knitted fabric. On the other hand, the element attaching portion is composed of double layer structure by double row needles so as to surround the core material like the conventional art.

In the element attaching portion of the invention, plural groups of the double tricot knitting structures lapped alternately between the double row needles are main structures and at the same time, part of needle loops in a partial warp knitted structure of the tape main body are overlapped with needle loops, which are part of the double tricot knitting structure. Consequently, the knitting pattern of the element attaching portion on the side of the tape main body is overlapped with the knitting pattern of the tape main body.

This means that even if the core material is deviated toward one side of the tape at the time of knitting by the double row needles, a knitting structure on an opposite side to the deviated side is formed by overlapping needle loops of the double tricot knitting structure with needle loops of the other knitting structure. As a result, although the element attaching portion is swollen so as to be deviated toward one side of the tape surface according to the conventional art, according to the invention, both sides of the element attaching portion are swollen substantially equally with respect to the tape face. Further, the quantity of the swelling is increased, so that not only the element can be attached uniformly along attaching portion of the fastener tape, but also the tape main body and the element attaching portion are connected each other with normal warp knitting structure, thereby securing a sufficient attaching strength.

Further, according to the invention, because the core material is covered with plural groups of the double tricot knitting structures, the core material can be covered and held securely through its peripheral face at an equal attaching strength and with knitting yarn, so that the configuration of the element attaching portion is made uniform in the longitudinal direction thereof.

Further, it is specified that needle loops of part of the tape main body, with which the double tricot knitting structure in the element attaching portion is overlapped, are needle loops of a single cord knitting structure, tricot knitting structure or chain knitting structure, or it is possible to combine the needle loops of at least two of those structures. These are typical warp knitting structures, in which the needle loops are formed, may provide a stabilized knitting pattern of themselves and secure a high knitting strength. However, for example, the weft yarn inserting structure, which just connects wales between the tricot knitting structure and chain knitting structure, has no needle loops and does not directly form any knitting pattern. Thus, that weft yarn inserting structure cannot stabilize the knitting pattern or increase the knitting strength.

And further, the warp knitting structure of the tape main body of the invention is not restricted to the above described structure, but may be applied to the two needle stitching structure or other modified structures. Further, the thickness and expandability of the knitting yarn applied to the tape main body and element attaching portion may be selected appropriately depending on its use.

DESCRIPTION OF THE PREFERRED EMBODIMENTS

Figure 1:
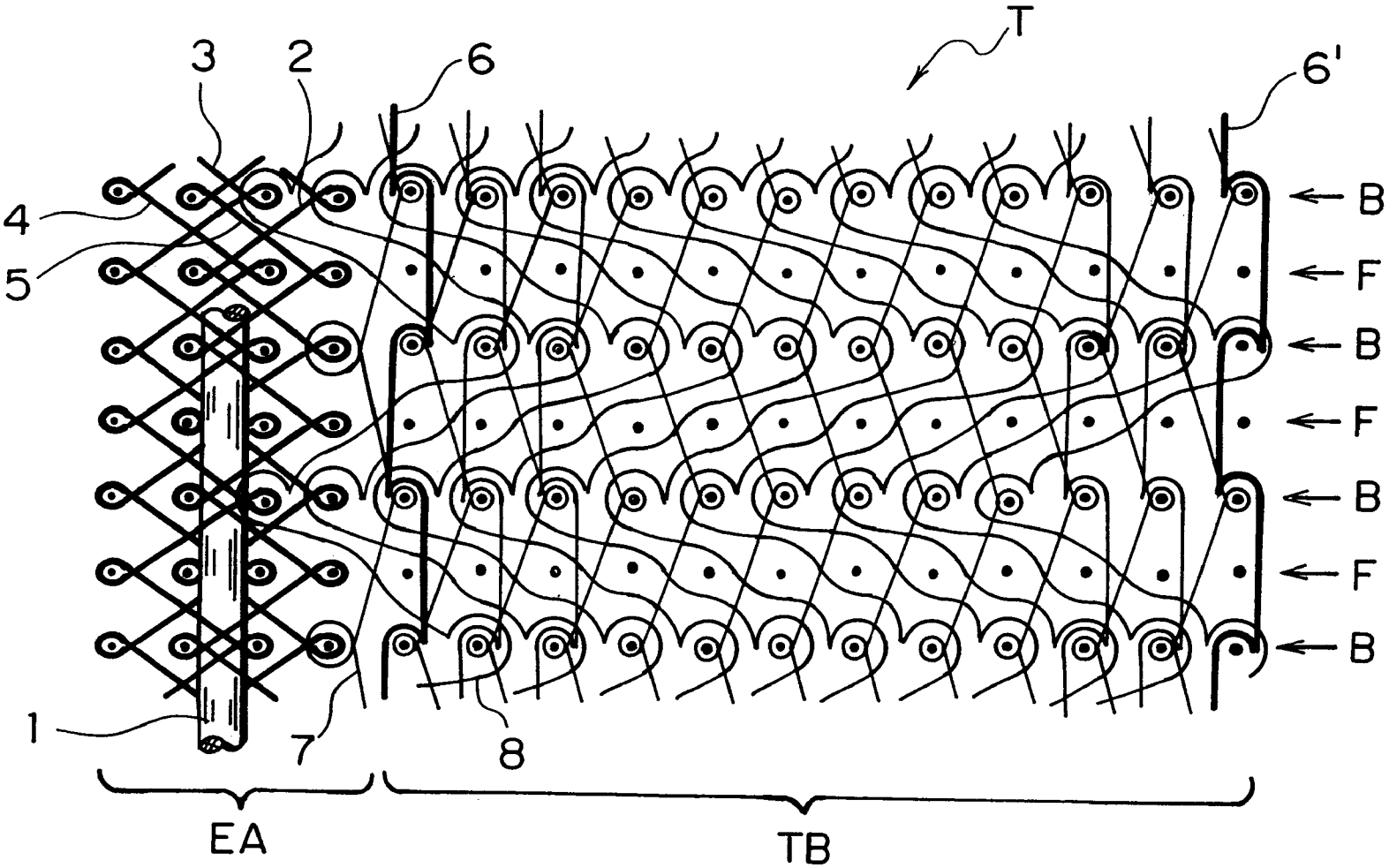
FIG. 1 is a knitting structure view of a slide fastener tape composed of warp knitting structure according to a first embodiment of the invention.

Hereinafter, the preferred embodiments of the invention will be described in detail with reference to the accompanying drawings. To facilitate understanding of structure and the like, in the drawings, the knitting pattern is drawn intentionally roughly and part of knitting yarn is partially drawn thicker while the other knitting yarn is drawn with an equal thickness. However, the actual knitting pattern is closer and a knitting yarn having arbitrary thickness and material can be selected and these factors are not restricted to the drawings represented here.

Figure 2:
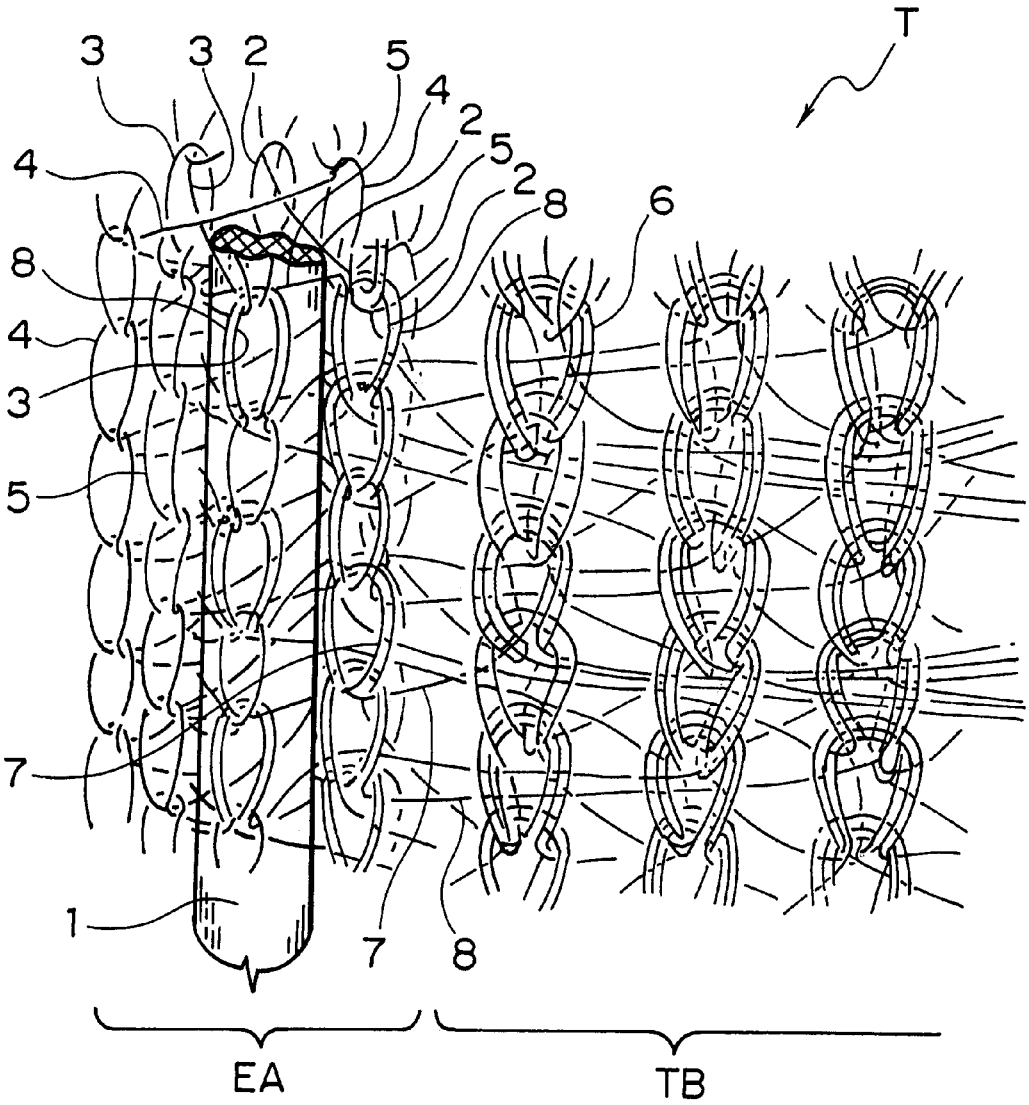
FIG. 2 is a partial perspective view showing an outlined real knitting fabric structure of the fastener tape of FIG. 1.
Figure 3:
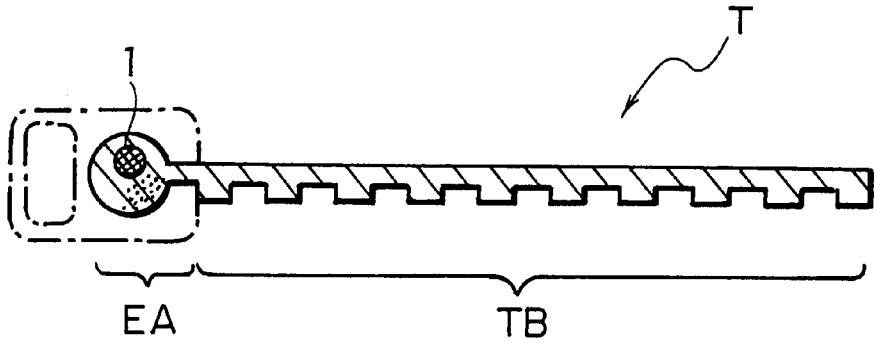
FIG. 3 is an explanatory view showing a section of the fastener tape of FIG. 1 as a model.
Figure 4:
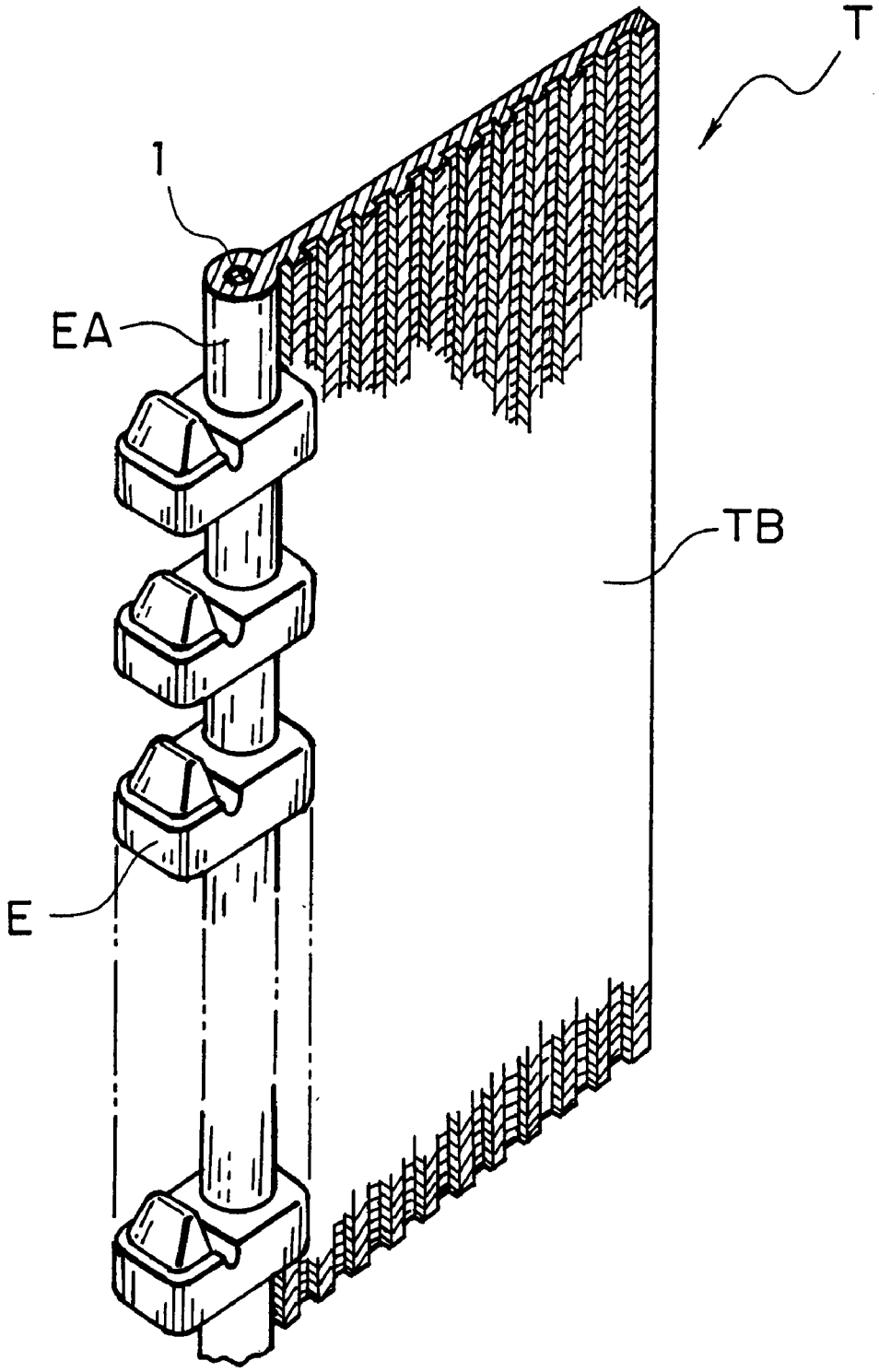
FIG. 4 is a partial perspective view of the fastener tape provided with an element.
Figure 5:
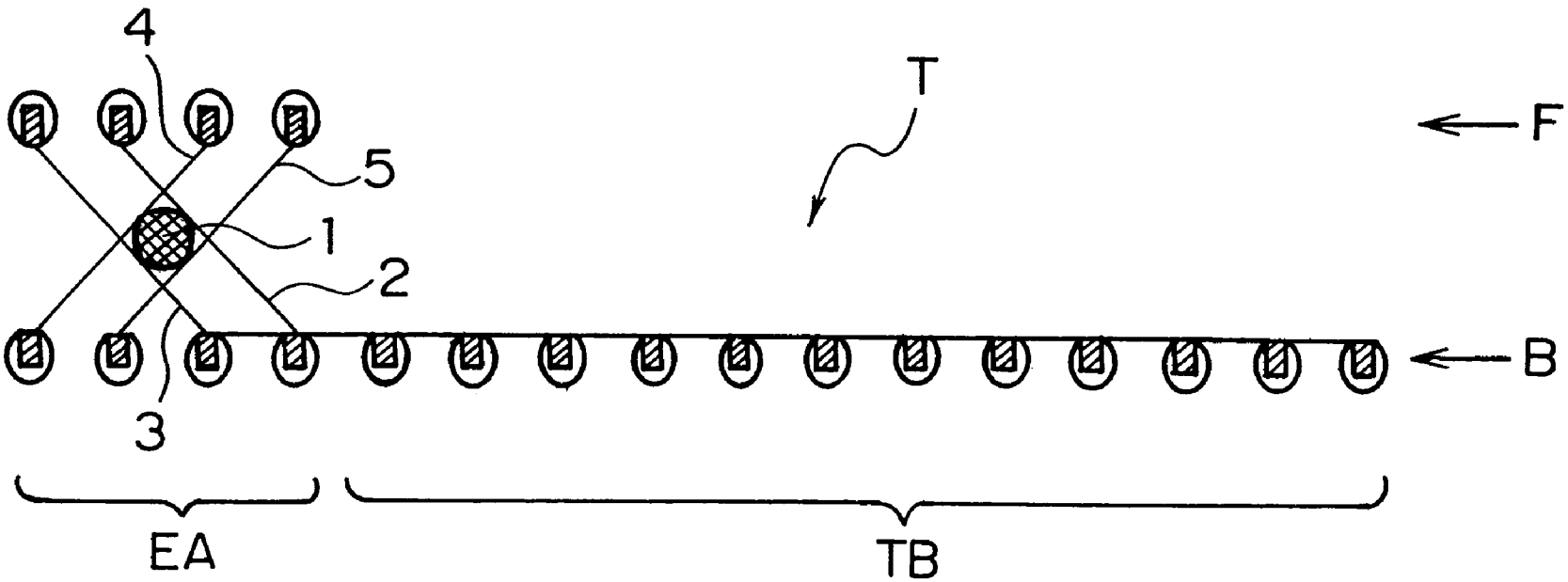
FIG. 5 is a sectional view showing plural rows of knitting needles and a form of knitting pattern as a model in the fastener tape of FIG. 1 by the warp knitting structure of the invention.

FIGS. 1 to 5 show typical embodiments of the invention. FIG. 1 is a plan view showing an entire warp knitting structure of a fastener tape. FIG. 2 is a partially enlarged view showing schematically the knitting structure and FIG. 3 is an explanatory view showing a section of the same tape as a model. FIG. 4 is a partial perspective view when the element is attached to the fastener tape and FIG. 5 is an explanatory view showing a knitting structure by double row needles as a model.

A fastener tape T of this embodiment comprises a tape main body TB having warp knitting structure and element attaching portion EA knitted integrally with the warp knitting structure along a side edge of the main body TB. According to this embodiment, as shown in FIG. 5, the said tape main body TB is warp-knitted by a single needle row of back needle row B and the element attaching portion EA is warp-knitted by double row needles composed of front needle row F and back needle row B.

Explaining with the knitting structure shown in FIG. 1, a core material 1 is inserted in the middle of double row needles composed of the front needle row F and the back needle row B with a warp inserting structure of 0-0/0-0/0-0/0-0, so that it extends between sinker loops knitted in the warp direction of the warp knitting structure of the element attaching portion EA. A peripheral face of the core material 1 is covered with the warp knitting structure of the element attaching portion EA such that it is surrounded all around.

The element attaching portion EA knitted as to cover the said core material 1 is composed of mainly two groups of first double tricot stitching structures 2 and 3 and second double tricot stitching structures 4 and 5. The double tricot knitting structures 2 and 3 of the first group are closed loops of 1-0/2-3/1-0/2-3 knitted by double row needles and the double tricot knitting structures 4 and 5 of the second group are also closed loops of 2-3/1-0/2-3/1-0 knitted by double row needles.

In this case, the double tricot knitting structures 2 to 5 of the two groups are warp-knitted such that the front needle row F and the back needle row B are lapped alternately as shown in FIG. 5, so that the core material 1 is inserted between the sinker loops of the double tricot knitting structures 2 to 5 of the two groups. Consequently, the peripheral face of the core material 1 is covered with the double tricot knitting yarn. FIG. 2 shows a concrete warp knitting configuration of the element attaching portion. As shown in the same Figure, the peripheral face of the core material 1 has a cylindrical warp knitting configuration, in which eight rows of wales formed by knitting needle loops continuously in a warp direction are connected with each other.

According to this embodiment, the said tape main body TB is knitted by the back needle row B and comprises single chain knitting structures 6 and 6' composed of open loops of 1-0/0-0/0-1/1-1 disposed at three wales near the element attaching portion EA and three wales at outside end of the fastener tape main body TB, a single tricot knitting structure 7 composed of closed loops of 1-2/1-1/1-0/1-1 knitted on substantially entire width of the tape main body TB and single cord knitting structure 8 composed of open loops of 0-1/2-2/4-3/2-2 knitted on substantially entire width of the tape main body TB.

The said chain knitting structure of this embodiment may be disposed on substantially entire width of the fastener tape main body TB depending on the use of the slide fastener. Alternatively, by excluding the chain knitting structure 6' of three wales located at the most outside end in the illustrated example, a slide fastener expandable in the warp direction, adaptable for clothes produced of expandable fabric can be obtained. Although in the illustrated example, the chain knitting structures 6 and 6' and single cord knitting structures 8 are knitted with open loops while the tricot knitting structures 2 to 5 and 7 are knitted with closed loops, the invention is not restricted to the illustrated embodiments, but the closed loops or open loops may be determined arbitrarily.

Needle loops which are part of the single tricot knitting structure 7 and the single cord knitting structure 8 composing part of the fastener tape main body TB are knitted together, in a manner of overlapping, with part of the needle loops formed by the back needle row B in the double tricot knitting structures 2 and 3 of the first group of the element attaching portion EA. In this case, parts of the overlapping tricot knitting structure 7 and single cord knitting structure 8 are used for connecting the tape main body TB with the element attaching portion EA.

In the element attaching portion EA adjacent to a side end of the fastener tape main body TB, the wales of the double tricot knitting structures 2 and 3 of the first group are formed continuously in the warp direction such that part of the needle loops thereof is overlapped independently by the needle loop of the single tricot knitting structure 7 and the single loop of the single cord knitting structure 8 crossing over the fastener tape main body TB.

The needle loops formed by the back needle row B of the double tricot knitting structures 2 and 3 of the first group is overlapped with the needle loops of the single tricot knitting structure 7 and the single cord knitting structure 8 in the tape main body TB formed by the back needle row B. Therefore, even if the core material 1 knitted in between the back needle row B and the front needle row F is deviated toward a side of the front needle row F, the element attaching portion EA is largely swollen toward the back needle row B which is a knitting side of the tape main body TB with respect to the core material 1. As a result, the swelling of the element attaching portion EA is substantially equal with respect to the tape.

Because of the configuration of the element attaching portion EA, the element E can be attached uniformly and accurately along the side edge of the fastener tape T. Further, because the swelling amount of the element attaching portion EA is increased in total, not only the element E can be attached securely, but also the element attaching portion EA is reinforced by the overlapped needle loops. Consequently, the attaching strength of the element E is increased so that the element E can be held firmly.

Figure 6:
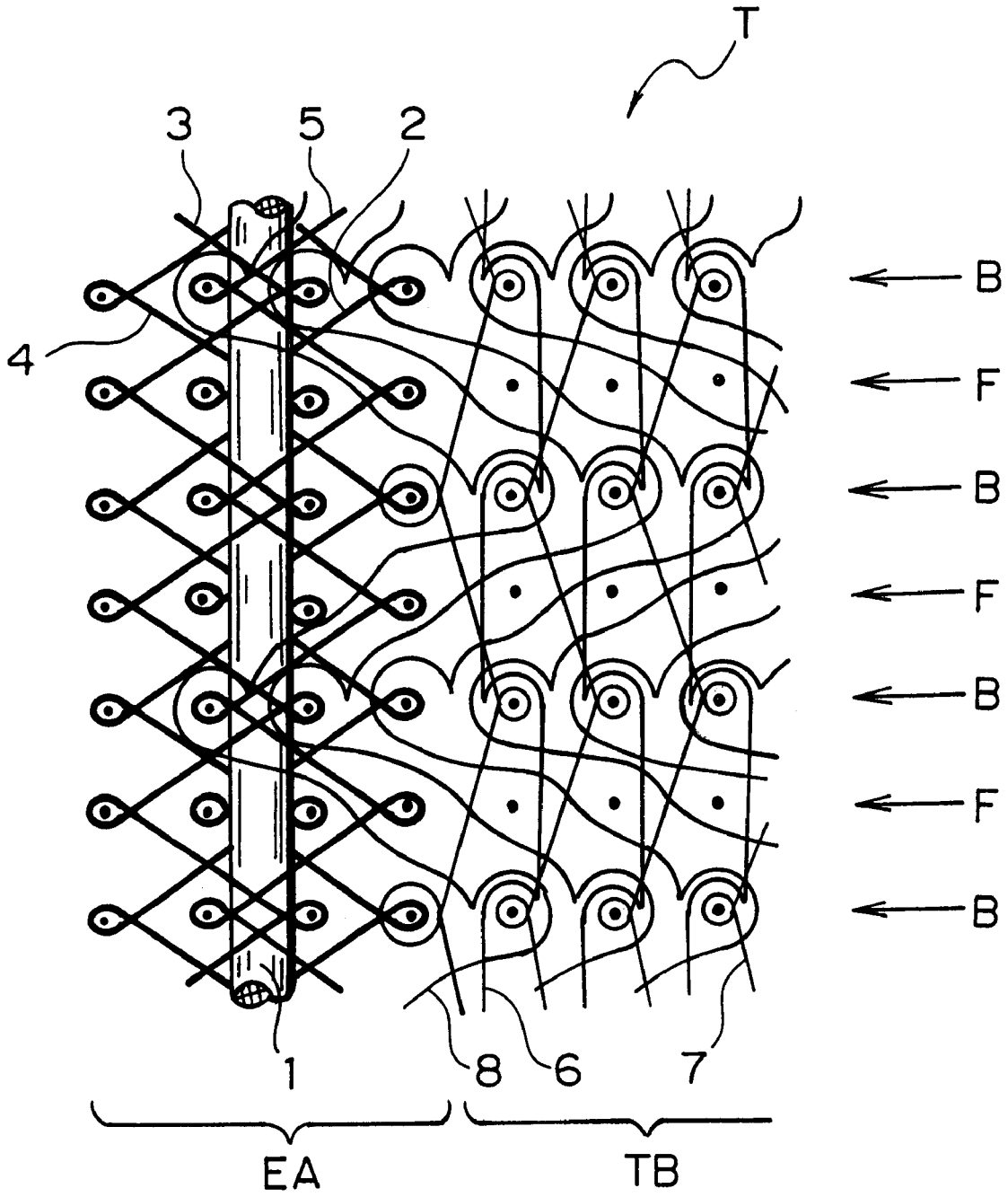
FIG. 6 is a partial knitting structure view of a slide fastener tape composed of warp knitting structure according to a second embodiment of the invention.

FIG. 6 shows a second embodiment of the invention. In addition to the structure of the previously described embodiment, part of the needle loops formed by the back needle row B of the double tricot knitting structure 5, of the double tricot knitting structures 4 and 5 of second group formed in the element attaching portion EA, is overlapped with the needle loops of the single cord knitting structure 8 formed by the back needle row B which is part of the composing structure of the tape main body TB.

By forming the element attaching portion EA in such a warp knitting structure, the swelling of the element attaching portion EA can be further enlarged. Additionally, even if the core material 1 is deviated to some extent at the time of knitting, the element attaching portion EA can be swollen substantially symmetrically from the front and rear surfaces of the fastener tape T.

Although according to the above embodiment, the tape main body TB is knitted by a single needle row of the back needle row B, it is permissible that the fastener tape main body TB is knitted by the front needle row F and basically nothing will change from the above-described embodiments. This is the same in embodiments which will be described below.

Figure 7:
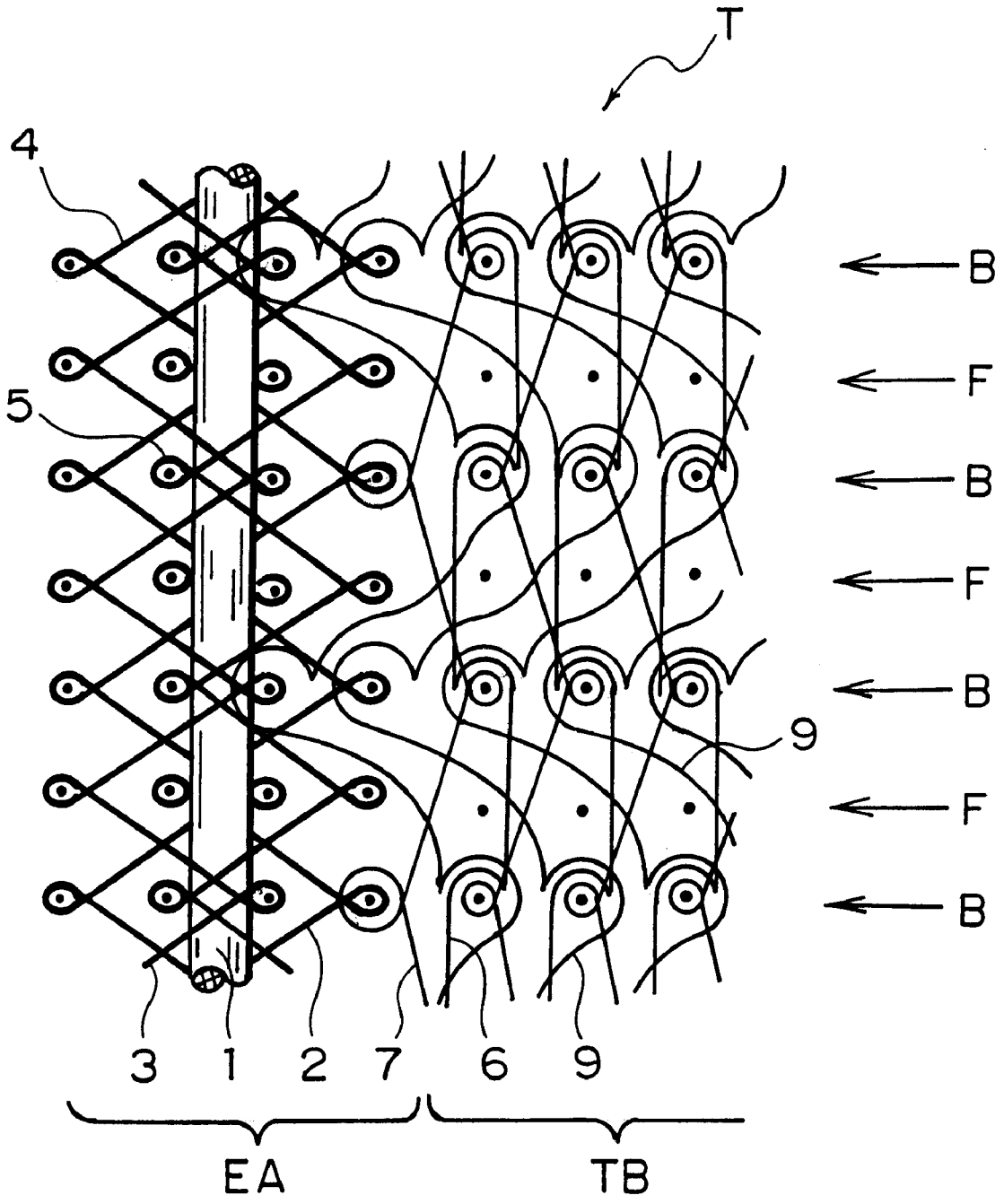
FIG. 7 is a partial knitting structure view of a slide fastener tape composed of warp knitting structure according to a third embodiment of the invention.

FIG. 7 shows a third embodiment of the invention. Although the single cord knitting structure 8 composing the fastener tape main body TB crosses over four wales according to the first embodiment, according to this embodiment, the knitting structure of 0-1/1-1/3-2/1-1 in which the single cord knitting structure 9 crosses over three wales is employed. Meanwhile, in the single cord knitting structure 9 also, the open loops may be exchanged with the closed loops.

Figure 8:
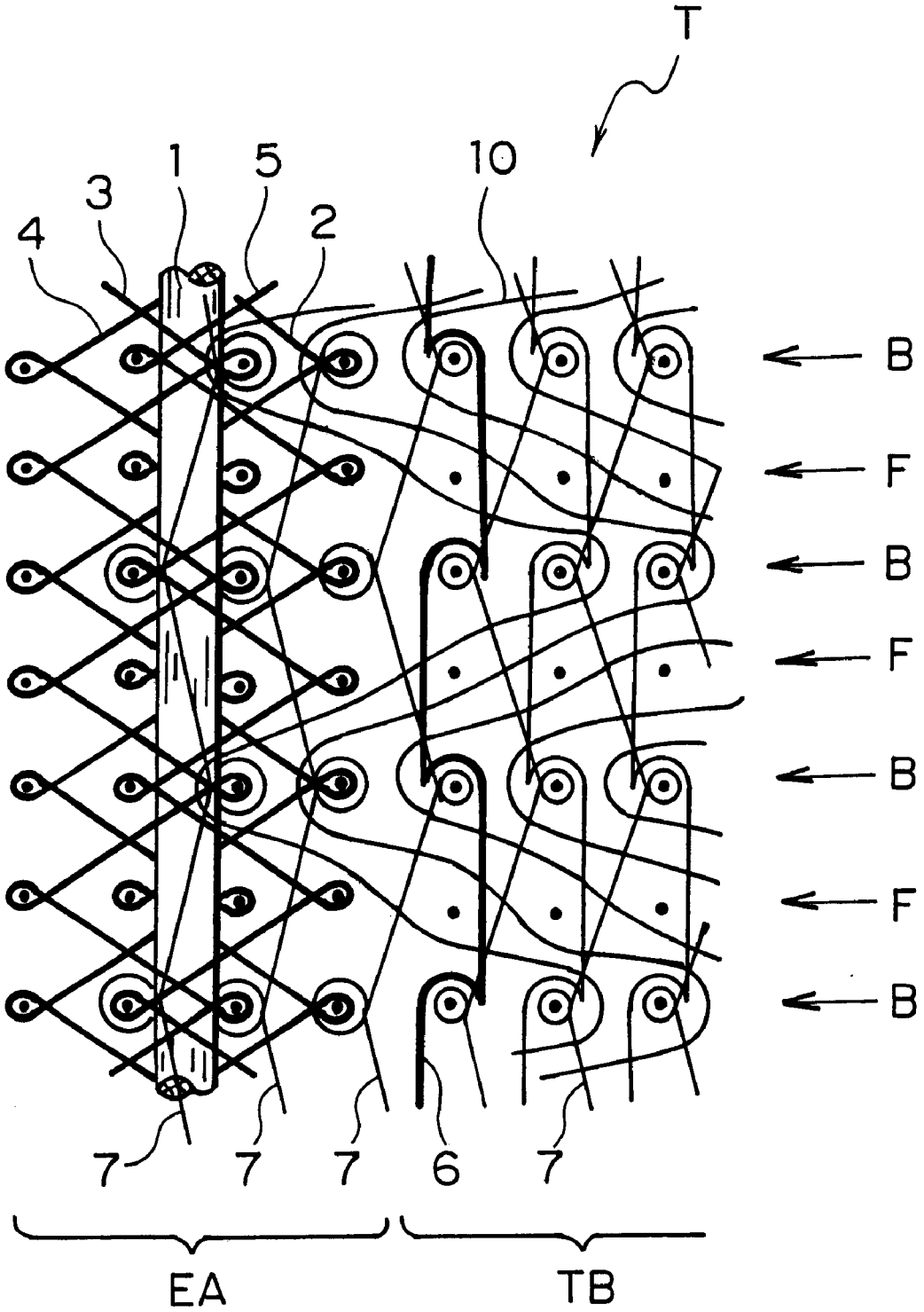
FIG. 8 is a partial knitting structure view of a slide fastener tape composed of warp knitting structure according to a fourth embodiment of the invention.

FIG. 8 shows a fourth embodiment of the invention. According to this embodiment, the weft yarn inserting structure 10 of 0-0/2-2/4-4/2-2 is employed instead of the single cord knitting structures 8 and 9 of the above described respective embodiments. This weft yarn inserting structure 10 is inserted into part of the needle loops of the double tricot knitting structures 2 and 3 of the first group of the element attaching portion EA while crossing over the fastener tape main body TB and is also used for connecting the tape main body TB with the element attaching portion EA.

According to this embodiment, the needle loops of the wale produced by the double tricot knitting structure 2 of the element attaching portion EA adjacent to a side end of the fastener tape main body TB is overlapped with the needle loops of the single tricot knitting structure 7 of the fastener tape main body TB side.

More concretely, two single tricot knitting structures 7 of the fastener tape main body TB are disposed on three wales formed by the double tricot knitting structures 2, 3 and 5 in the element attaching portion EA disposed on a side end of the fastener tape main body TB using the back needle row B and are knitted throughout those three wales. Consequently, the needle loops of the double tricot knitting structures 2, 3 and 5 in the element attaching portion EA are overlapped with the needle loops of the these two single tricot knitting structures 7.

Further, according to this embodiment, in addition that the single tricot knitting structure 7, knitted in the element attaching portion EA, is disposed on the said three wales, the single tricot knitting structure comprised of the same knitting structure is disposed on a wale disposed most outside and formed by the double tricot knitting structure 4. At the same time, part of the needle loops of the double tricot knitting structure 4 may be overlapped with the needle loops of the single tricot knitting structure in that wale.

Figure 9:
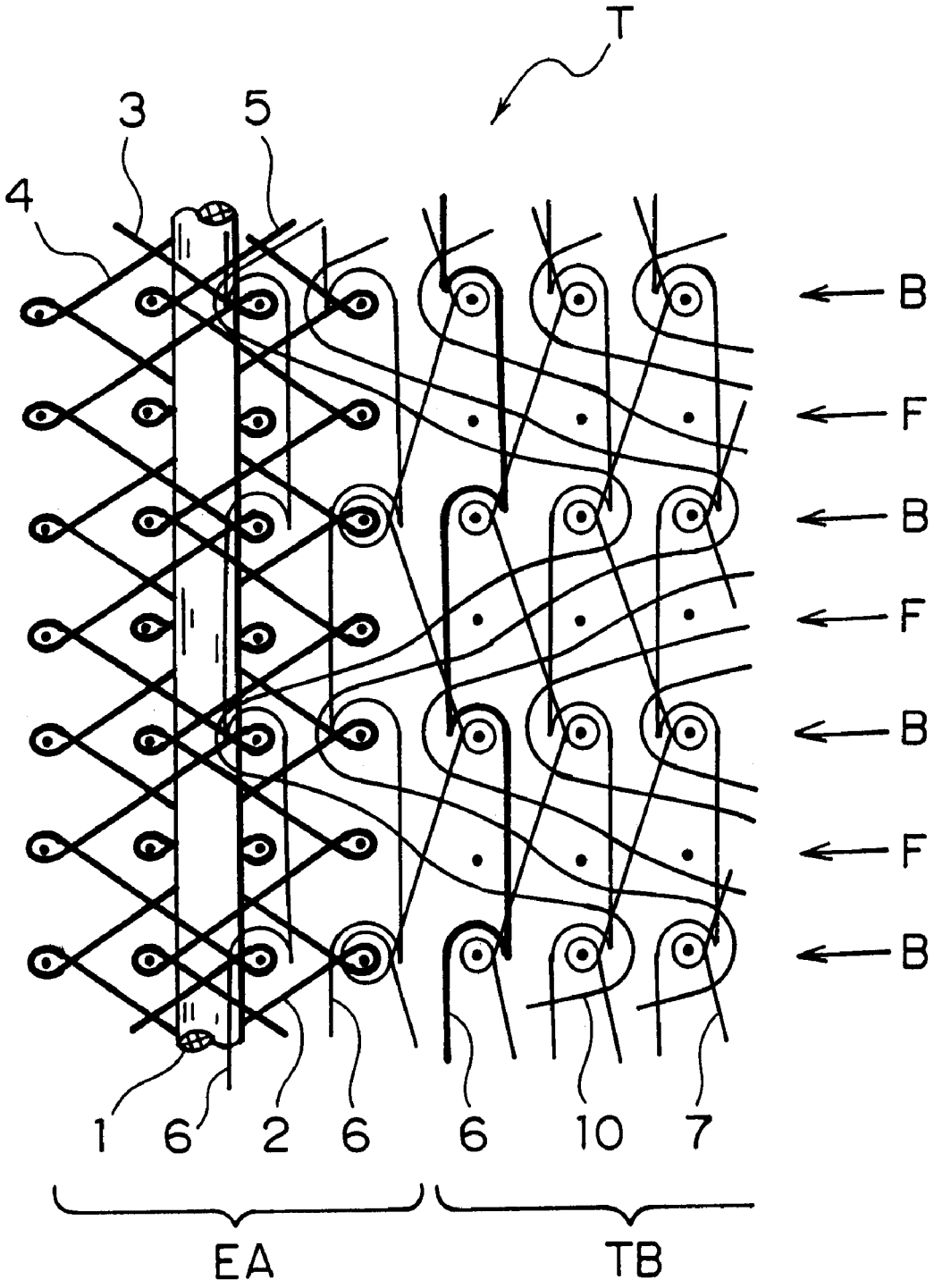
FIG. 9 is a partial knitting structure view of a slide fastener tape composed of warp knitting structure according to a fifth embodiment of the invention.

FIG. 9 shows a fifth embodiment of the invention. According to this embodiment, instead of the two single tricot knitting structures 7 disposed in the element attaching portion EA of the fourth embodiment, the chain knitting structure 6 of two wales is disposed using the back needle row B. Consequently, part of the needle loops formed in two wales of the double tricot knitting structures 2 and 3 of the first group in the element attaching portion EA adjacent to the fastener tape main body TB are overlapped with the needle loops of the chain knitting structure 6.

According to this embodiment also, not only the said chain knitting structure 6 is disposed on the two wales in the element attaching portion EA, but also by disposing the chain knitting structure on a wale formed by the back needle row B in the double tricot knitting structure 5 adjacent to the two wales, part of the needle loops formed by the double tricot knitting structure 5 can be overlapped with the needle loops of the chain knitting structure 6. Further, it is also permissible to not only dispose the same chain knitting structure on the wale by the double tricot knitting structure 4 disposed most outside but also overlap part of the needle loops of the double tricot knitting structure 4 with the needle loops of the wale formed by the chain knitting structure.

The invention is not restricted to the above described embodiments, but it is permissible to employ two needle stitching structure for part of the knitting structure of the tape main body TB of the above embodiments. That is, it is permissible to employ other knitting structures or combine those knitting structures. Further, the material and thickness of knitting yarn for use in those knitting structure may be selected appropriately depending on the use of the slide fastener. For example, if a thicker yarn than the other composition yarn is used for as the knitting yarn for use in the chain knitting structure 6 near the element attaching portion EA is expressed with a thicker line in FIGS. 1, 8 and 9, the thickness of tape in a connecting portion between the element attaching portion EA and the tape main body TB, which is likely to be formed thin, can be formed relatively thick, so that the attaching strength and attaching configuration of the element E can be intensified as well as that portion is reinforced.

What is claimed is:

1. A slide fastener tape composed of warp knitting structure having an element attaching portion knitted integrally with a tape main body along a side edge thereof, wherein said tape main body is composed of warp knitting structure formed by one row needle of double row needles, and said element attaching portion has a core material and is composed of plural groups of double tricot knitting structures lapped alternately between double row needles so as to surround a peripheral portion of the core material and a knitting structure which is part of said tape main body, and needle loops of the knitting structure, which is part of said tape main body, are overlapped with needle loops, which are part of said double tricot knitting structure.

2. A slide fastener tape according to claim 1, wherein needle loops of part of the tape main body overlapped with the double tricot knitting structure in said element attaching portion are needle loops of a single cord knitting structure.

3. A slide fastener tape according to claim 1, wherein needle loops of part of the tape main body overlapped with the double tricot knitting structure in said element attaching portion are needle loops of a tricot knitting structure.

4. A slide fastener tape according to claim 1, wherein needle loops of part of the tape main body overlapped with the double tricot knitting structure in said element attaching portion are needle loops of a chain knitting structure.

5. A slide fastener tape according to claim 1, wherein needle loops of part of the tape main body overlapped with the double tricot knitting structure in said element attaching portion are needle loops of at least two structures of the single cord knitting structure, the tricot knitting structure and the chain knitting structure.

* * * * *